114-242

SR

12/21/82 XR 4,364,734

United States Patent [19]

Haughton et al.

[11] 4,364,734

[45] Dec. 21, 1982

[54] INFLATABLE MARINE CRAFT HAVING IMPROVED TOWING CHARACTERISTICS

[75] Inventors: Geoffrey J. S. Haughton; Malcolm Bimpson, both of Sutton Coldfield, England

[73] Assignee: Dunlop Limited, London, England

[21] Appl. No.: 252,237

[22] Filed: Apr. 8, 1981

Related U.S. Application Data

[63] Continuation of Ser. No. 901,639, May 1, 1978, abandoned.

[30] Foreign Application Priority Data

May 7, 1977 [GB] United Kingdom ..... 19261/77

[51] Int. Cl.[3] ..... B63C 9/04

[52] U.S. Cl. ..... 441/37; 114/242; 114/345; 441/40; 441/79

[58] Field of Search ..... 114/242, 244, 245, 253, 114/145 R, 145 A, 345, 246; 43/42.22; 441/37, 40, 35, 65, 66, 68, 72, 73, 79, 87

[56] References Cited

U.S. PATENT DOCUMENTS

| | | | |
|---|---|---|---|
| 1,615,568 | 1/1927 | Carroll | 9/11 R |
| 1,829,471 | 10/1931 | Brimhall | 441/65 |
| 2,010,371 | 8/1935 | Perri | 441/35 |
| 2,396,212 | 3/1946 | Spanel | 9/11 A |
| 3,103,673 | 9/1963 | Martin, Jr. | 441/79 |
| 3,272,171 | 9/1966 | Korcak | 114/145 R |
| 3,654,724 | 4/1972 | Charron | 43/42.22 X |
| 3,871,042 | 3/1975 | Farmer | 9/11 A |
| 3,931,777 | 1/1976 | Colgan | 441/65 |

FOREIGN PATENT DOCUMENTS

| | | | |
|---|---|---|---|
| 142950 | 11/1949 | Australia | 441/79 |
| 926704 | 5/1973 | Canada | 114/244 |
| 2109677 | 5/1972 | France . | |
| 921353 | 3/1963 | United Kingdom . | |
| 957480 | 5/1964 | United Kingdom . | |
| 1281285 | 7/1972 | United Kingdom . | |
| 1362865 | 8/1974 | United Kingdom . | |
| 1432585 | 4/1976 | United Kingdom . | |
| 1461218 | 1/1977 | United Kingdom . | |

*Primary Examiner*—Sherman D. Basinger

*Attorney, Agent, or Firm*—Stevens, Davis, Miller & Mosher

[57] ABSTRACT

One or more vanes of a rigid or flexible material are attached to the underside of a liferaft or other towable marine craft. The vane or vanes are suspended from the craft at an angle of 90° or less relative to the direction of towing.

7 Claims, 6 Drawing Figures

INFLATABLE MARINE CRAFT HAVING IMPROVED TOWING CHARACTERISTICS

This is a continuation of Ser. No. 901,639 filed May 1, 1978 which is now abandoned.

This invention relates to marine craft, and particularly but not exclusively to marine craft made wholly or partly from water-impermeable, flexible sheet material. Such craft includes liferafts, dinghies and flexible barges.

The present invention will be described herein with particular reference to inflatable liferafts, but is not intended to be limited thereto.

Inflatable liferafts are now well known and are carried on many vessels. Such rafts generally comprise one or more inflatable buoyancy tubes arranged in a circular or ellipsoidal plan form and having a flexible floor and a flexible roof attached to opposite sides of said tube or tubes. The roof may be supported by means of inflatable struts or arches.

When required for use, the rafts are inflated on or near to the vessel being evacuated and are then boarded. It has been the practice to encourage boarders to maintain the location of the raft close to the position at which it was boarded so as to facilitate subsequent search operations. The successful outcome of a search would result in the raft passengers being transferred to a conventional vessel.

More recently it has been proposed that liferafts should be taken in tow by a powered vessel and the passengers landed ashore. It has, however, been found that many commercially available inflatable liferafts are not amenable to towing at or above certain critical speeds. The critical speeds will depend upon the type of liferaft to be used and tend to be influenced by prevailing sea conditions. They are quite low, for example less than 3 to 4 knots.

At the critical speed, a liferaft exhibits a tendency to nose-dive and an irregular, undulating motion occurs. In an observed situation, the bow of a towed raft repeatedly dived beneath the water and the raft became water-filled. It remained afloat due to its reserve buoyancy but its efficiency as a life-saving apparatus was substantially reduced.

The phenomenon described in the immediately-preceding paragraph is similar to those described as "hogging" and "porpoising" with reference to inflatable boats. It is believed to result from viscous drag on the underside of the flexible floor. At the critical speed, drag causes tensile forces to develop which exert a tensile load on the floor in the opposite direction to the towing force. One effect of the tensile load is the creation of a bending effect in the region where the towing force is applied. Arching occurs in the buoyancy tubes and the bow deflects downwards.

A possible remedy would be to design a liferaft having a more "boat-like" hull. Such a remedy would, however, be prohibitively expensive and would create problems in other aspects of liferaft design. It would also be inapplicable to the many thousands of rafts already in service throughout the world.

It is an object of the present invention to provide a means of improving the towing characteristics of a liferaft, said means being capable of incorporation both in liferafts under construction and in already-made liferafts.

The invention seeks to improve the towing performance of marine craft by introducing a resistance to water movement under the craft.

Thus the present invention provides means for improving the towing characteristics of marine craft, the means comprising one or more vanes, each vane being attached by one edge to the underside of the craft and suspended therefrom to make an angle of 90° or less with the underside of the craft, relative to the direction of towing.

Stated in other words, the present invention provides an inflatable marine craft made of a flexible sheet material and having one or more vanes, each vane being attached by one edge to the underside of the craft and suspended therefrom to make an angle of 90° or less with the underside of the craft, relative to the direction of towing.

The invention will be further described, merely by way of example, as applied to an inflatable liferaft and with reference to the accompanying drawings, in which.

Figure 3:
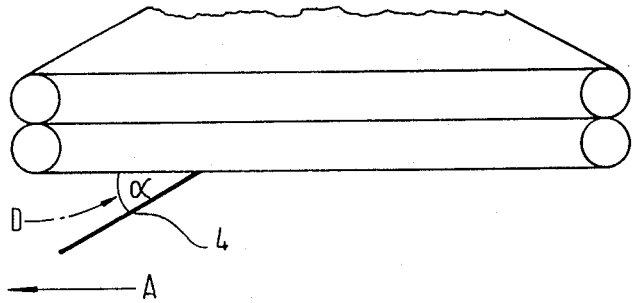
FIG. 3 shows an inflatable liferaft having a vane attached to its underside.
Figure 3A:
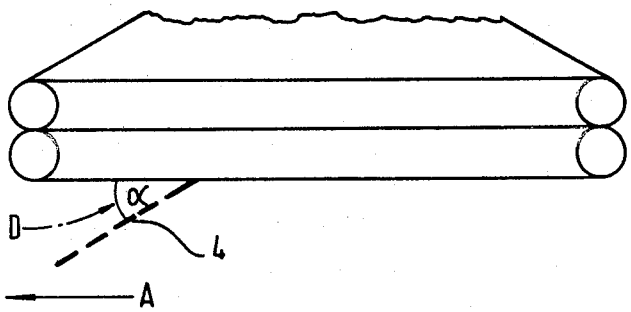
Figure 4:
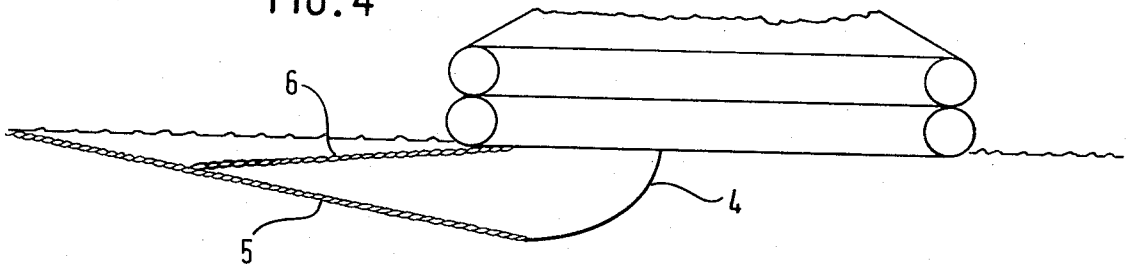
Figure 5:
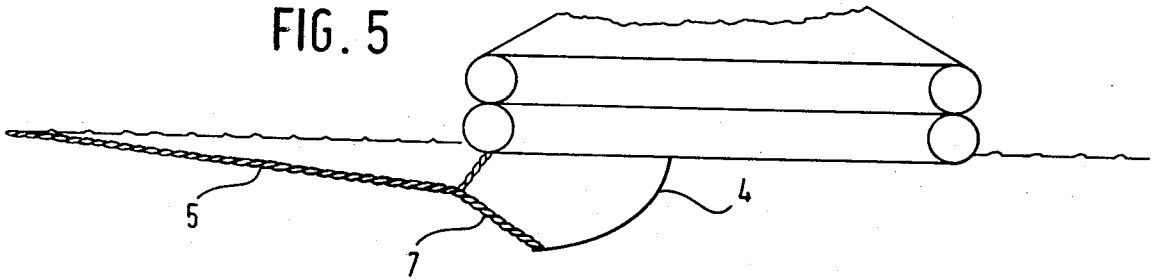

FIG. 3*a* shows an inflatable liferaft having a perforate vane attached to its underside;

FIGS. 4 and 5 show two ways of incorporating towing means in the liferaft of FIG. 3.

Figure 1:
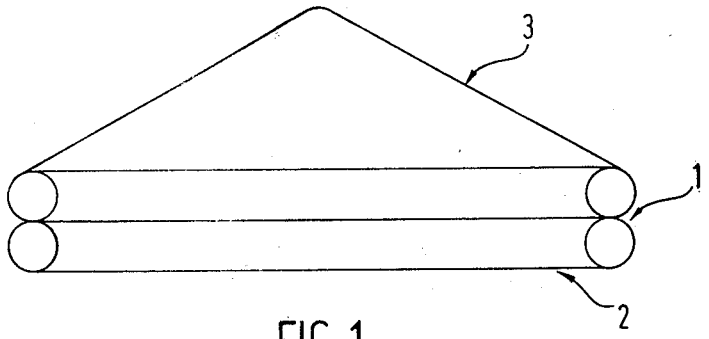
FIG. 1 is a schematic cross-sectional view of a known inflatable liferaft.
Figure 2:
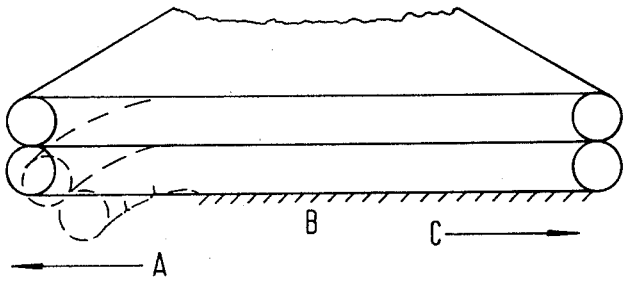
FIG. 2 shows the liferaft of FIG. 1 under towing conditions.

Referring now to FIG. 1, the liferaft comprises two, generally annular, superposed buoyancy tubes (1), a flexible floor (2) and a canopy (3). As shown in FIG. 2, a towing force is exerted in the direction of arrow A by means of a painter or similar line. Viscous drag is set up at the interface B resulting in a tensile force, indicated by the arrow C, in the floor material. At critical speeds, the bow of the raft is forced downwards as indicated by the broken lines.

Referring now to FIG. 3, a vane 4 is attached by its upper edge to the underside of the raft floor. The lower edge of the vane is suspended (by means not shown) at a point some distance below the raft so as to define an angle $\alpha$ between the vane and the raft. When the raft is towed in the direction of arrow A, the vane will tend to act as a brake. It is therefore surprising that, at critical speeds, the vane 4 substantially improves the towing characteristics of a raft. In particular it effectively prevents the "nose-diving" phenomenon by causing the bow to deflect upwards instead of downwards. This beneficial effect is believed to arise from a change in direction of the water force effected by the vane 4 and shown by arrow D. It appears that lateral movement of the water is converted into generally vertical movement. At speed, the effect is comparable to that produced by a continuous, lubricated, inclined plane. A further benefit is that the turbulence created aft of element 4 produces a lower viscous drag than would occur with a relatively uniform, lateral movement of water.

In FIG. 4, a vane 4 is provided at its lower edge with one or more towing lines 5. Each line is attached at its distant end to a towing vessel (not shown). A further line 6 is attached at one end to the raft and at its other end to towing line 5.

In FIG. 5, a towing line 5 is attached to an intermediate line 7, one end of which is attached to the raft and the other to the edge of vane 4.

It will be apparent that the invention can take various forms and is applicable to various types of marine craft. Vane 4 may, for example, comprise a continuous, imperforate web, attached to the underside of a marine craft.

Alternatively, the web may be incorporated in a towing array adapted for attachment to a marine craft.

The vane 4 may also be perforated (as shown in FIG. 3*a*) or otherwise adapted so as to deflect only part of the water flow. It may also be so shaped as to direct the water flow as desired and may be provided with means to vary its characteristics.

When applied to craft made wholly or partly from flexible materials, the vane may be constructed from one or more flexible materials. In the case of a liferaft, such a construction would not significantly affect the requirement that the raft be suitable for compact packing in a container.

In the case of craft made from rigid materials, the vane may be made from one or more rigid materials.

Although, in the foregoing example, reference has been made to a single vane 4, it is within the scope of the invention to provide a plurality of such vanes.

Similarly, although reference has been made to a single towing line 5, it is within the scope of the invention to provide a plurality of such lines.

Having now described our invention - what we claim is:

1. A towable, inflatable, floatable, marine craft having a generally flat underside and means to prevent nose diving which results in irregular undulating motion of said craft when said craft is being towed, said means comprising at least one vane attached to and extending downwardly from the underside of said craft, with its point of attachment being spaced back from the front edge of the underside, and suspended therefrom to form a pocket between the underside and the upper surface of the vane so that, when said craft is being towed, the upper surface of said at least one vane makes an angle of 90° or less with the underside of said craft, relative to the direction of towing.

2. In an inflatable, floatable marine craft made of flexible sheet material and having a generally flat underside, an improvement comprising a means to prevent nose diving which results in irregular undulating motion of said craft when said craft is being towed, said means comprising:

at least one vane, attached by one of its edges to the generally flat underside of said craft and suspended and extending downwardly to make an angle of 90° or less with said underside, the angle being relative to the direction of towing.

3. The craft of claim 1 in which said at least one vane includes at least one towing attachment device.

4. The craft of claim 1 in which said at least one vane comprises a continuous imperforate web.

5. The craft of claim 1 in which said at least one vane is perforate.

6. The craft of claim 1 in which said at least one vane is made from flexible materials.

7. The craft of claim 1 in which said at least one vane is made from rigid materials.

* * * * *